United States Patent [19]

Poerink

[11] 3,968,528

[45] July 13, 1976

[54] BEDSTEAD HAVING A WOVEN SUPPORT

[76] Inventor: Jannes Jonge Poerink, 25 Prins Bernardlaan, Borne, Netherlands

[22] Filed: Apr. 23, 1974

[21] Appl. No.: 463,645

[30] Foreign Application Priority Data

Apr. 26, 1973 Germany ..... 2321037

[52] U.S. Cl. ..... 5/211; 5/189; 160/328; 160/378; 256/37

[51] Int. Cl.[2] ..... A47C 19/00

[58] Field of Search ..... 5/211, 218, 220, 223–225; 160/378, DIG. 15, 377, 379, 380, 328; 256/37

[56] References Cited

UNITED STATES PATENTS

| | | | |
|---|---|---|---|
| 371,767 | 10/1887 | Klein | 5/225 R X |
| 630,744 | 8/1899 | Russell | 5/211 X |
| 805,764 | 11/1905 | Wheelock et al. | 256/37 |
| 1,572,831 | 2/1926 | Ayres | 160/378 X |
| 2,218,451 | 10/1940 | Heyne | 160/378 X |
| 2,533,565 | 12/1950 | Eichelman | 160/378 X |
| 2,615,178 | 10/1952 | Karg | 5/220 X |
| 2,839,126 | 6/1958 | O'Neill | 160/DIG. 15 |
| 3,483,912 | 12/1969 | Andrews | 160/380 X |
| 3,666,277 | 5/1972 | Hubach et al. | 160/378 X |
| 3,800,697 | 4/1974 | Sullivan | 160/378 X |

FOREIGN PATENTS OR APPLICATIONS

| | | | |
|---|---|---|---|
| 8,149 | 9/1893 | United Kingdom | 5/220 |

*Primary Examiner*—Paul R. Gilliam
*Assistant Examiner*—Carl F. Pietruszka
*Attorney, Agent, or Firm*—Burgess, Dinklage & Sprung

[57] ABSTRACT

A bedstead is disclosed including crossheads between which a woven mat support is stretched. The mat is made of spring steel wire, preferably plastic coated and includes longitudinal wire members having U-shaped ends. Hook rails are carried by the crossheads and have adjacent recesses between which they define V-shaped hook members. One of the hook rails is adjustable so as to tension the mat support. A U-shaped clamping bar is provided into which the U-shaped ends of the longitudinal wire members are fitted. A resilient intermediate layer is positioned between the clamping bar and the U-shaped ends of the longitudinal wire members. The clamping bar is positioned in the V-shaped hook members of the adjustable hook rail such that a clamping force is exerted on the U-shaped ends of the longitudinal wire members by the clamping bar in proportion to tension force applied to the mat support by the adjustable hook rail.

5 Claims, 5 Drawing Figures

BEDSTEAD HAVING A WOVEN SUPPORT

The present invention relates to a bedstead having a woven support consisting of spring steel wires, preferably plastic covered spring steel wires, and a hook rail defining a plurality of hooks positioned in side-by-side relation on the crossheads of the bedstead and including recesses for passing the spring wires therethrough.

There are already known bedsteads having spring wire woven or mat supports wherein the longitudinal wires are also retained by means of a hook rail and wherein the longitudinal wires, upon passing them through said hook rail, are laid around a pair of transverse wires and which may be tensioned by means of the hook rail.

However, in these known bedstead constructions it has been found to be disadvantageous that, under certain circumstances, the individual transverse wires may be subjected to an excessive load, that the production and the exertion of the tension for spring steel woven supports of this kind is complicated and, thus, uneconomical, and that, ultimately, the individual wires may break off.

Further, it is known that the longitudinal wires are welded to the transverse webs or to special tension bars. However, it has been found to be disadvantageous in this method that the welds are unsuitable for the high-strength steel employed, because the wires are apt to break adjacent the welds. Therefore, woven supports of this type must even be designated to be of no use.

Accordingly, it is the object of the invention to provide a bedstead having a spring steel woven or mat support which does no longer show the abovementioned disadvantages and those of the prior art and which, in particular, can be produced easily and economically, wherein a durable and secure tensioning of the longitudinal wires is ensured, wherein break off or tear off of the individual wires is positively prevented, and wherein an easily and readily adjustable high tension of the wires is maintained.

This object is solved in a bedstead of the type as outlined at the beginning in that said longitudinal wires are bent in U-shaped configuration and slid into a U-shaped clamping bar, whereby the hooks of said hook rail are formed with V-shaped configuration so as to exert a clamping force in proportion to the tension force. Preferably, in order to increase the clamping action and to avoid overloading of individual wires as well as breaking of individual wires there may be inserted between the longitudinal wires and the clamping bar, an elastic or resilient intermediate layer. The intermediate layer may comprise a plastic material strip placed into said clamping bar.

In order that the clamping bar including the intermediate layer can be readily applied, the intermediate layer may be bonded to the clamping bar or vulcanized thereto. In order to avoid wear of the wires in the region of the tensioning positions, the edges of the recesses in the hook rail may be spaced from the longitudinal wires.

In the following, an exemplary embodiment of the invention is described in greater detail by referring to the enclosed drawings, wherein.

Figure 1:
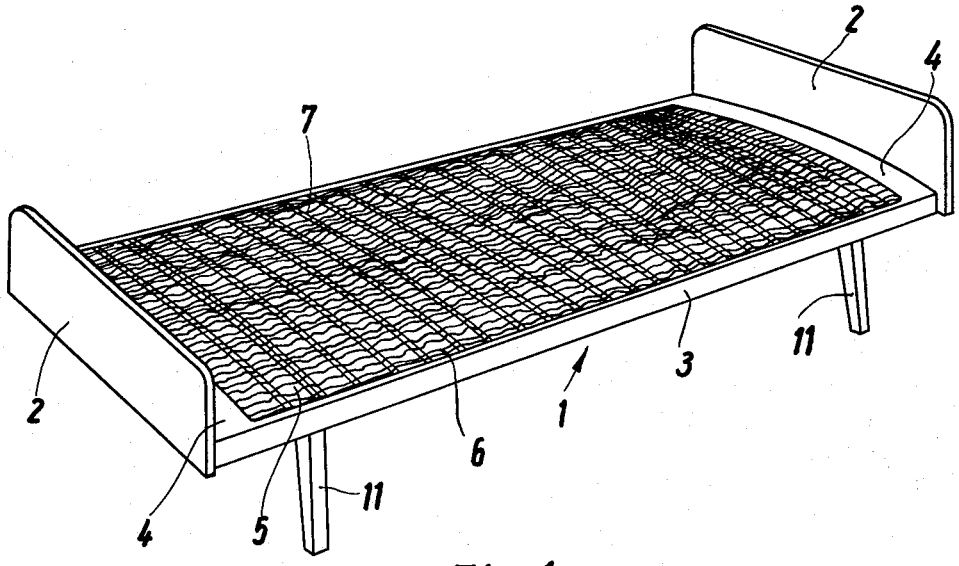
FIG. 1 is a perspective view of a bed having a spring steel woven or mat bottom support according to the invention.

As shown in FIG. 1, the bedstead according to the invention, indicated generally at 1, comprises a frame including head and foot boards 2 and longitudinal struts 3 as well as a spring steel mat support 5.

Inner crossheads 4 extend in parallel with the foot and head boards 2, which crossheads are integrally formed with, or welded to, the longitudinal struts 3. The bed rests on four legs 11 which may be secured to the longitudinal struts, too.

The crossheads 4 are of angled cross-sectional configuration. Between these crossheads, the spring steel mat support 5 is stretched, which mat support consists of longitudinal wires 6 and transverse wires 7.

Preferably, the wires are provided with a plastic cover 15, and the transverse wires may be bent at their ends and protected by a plastic strip or bar (not illustrated).

Figure 2:
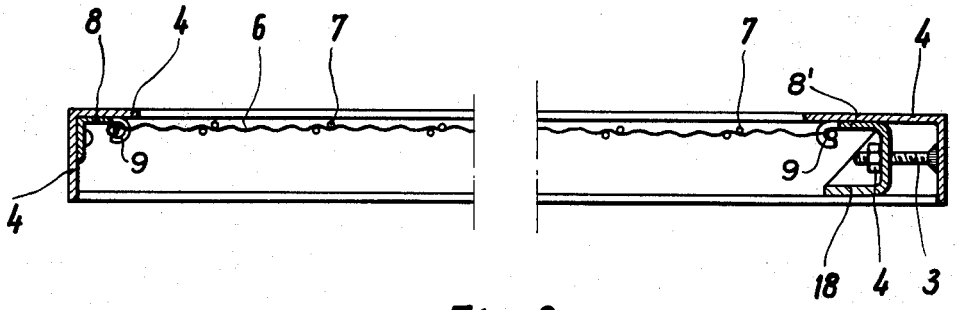
FIG. 2 is a schematical longitudinal section through a bed according to FIG. 1.

The spring steel mat support 5 is stretched over a pair of hook bars or rails, whereby the left hand hook bar 8 as shown in FIG. 2 is directly connected to the crosshead 4 through rivets, screws or by welding, while the right hand hook bar 8 is slidably arranged underneath the crosshead 4.

The hook bar 8′ includes a horizontal, continuous back flange 20 (FIG. 3) with which said bar slides on the horizontal flange of the crosshead 4. In order to avoid kinking of the hook bar 8′ under tension, the hook bar may be also of U-shaped cross-section and it may include a lower flange 18 which is adapted to slide within the longitudinal struts.

Figure 3:
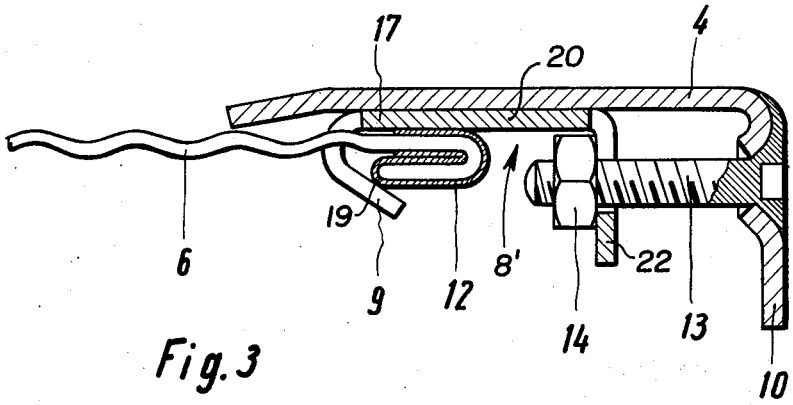
FIG. 3 is a sectional view of the tensioning device of the bedstead according to the invention.

The hook rails 8 and 8′ includes adjacently disposed V-shaped hook members 9 with recesses between them. Hook rail 8′ is adjustable in its position by means of a threaded bolt 13 (FIG. 3). The bolt 13 has a tapered head which is adapted to be inserted into a countersunk bore 10 or the crosshead 4. The bolt 13 carries a nut 14, and it passes through vertical flange 22 of the hook rail 8′. By turning the nut 14, the position of the hook rail 8′ may be adjusted and, thus, the tension of the spring steel mat support 5 may be set by adjusting the tension of the individual longitudinal wires.

The ends of the longitudinal wires 6 are bent in U-shaped configuration and laterally inserted into a U-shaped clamping bar 12 (FIGS. 3 and 4) which can have an intermediate layer 16 (FIG. 5) of an elastic or resilient material.

When tensioned, each of said V-shaped hook members 9 is pressed against the portion 19 of the clamping bar 12 (FIG. 3). In this way, a clamping action of the clamping bar proportional to the tension force and, thus, a securement of the longitudinal wires in proportion to the tension force is obtained.

Preferably, the intermediate layer 16 consists of a tough plastic material strip. In a manner being surprising to the expert, this makes it possible to securely clamp the plastic coated longitudinal wires without being compelled to remove the plastic cover 15. Of course, the clamping mechanism according to the invention is also effective when the coating 15 has been peeled off.

The resilient intermediate layer 16 is adhesively bonded within the clamping bar 12 or vulcanized thereto, such that it can be shaped with this clamping bar in a very easy manner.

Figure 4:
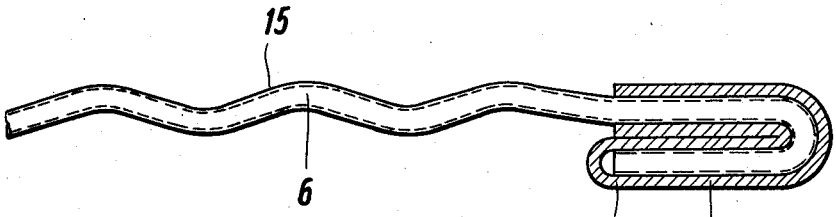
FIG. 4 is an enlarged view of a longitudinal wire including a clamping bar.
Figure 5:
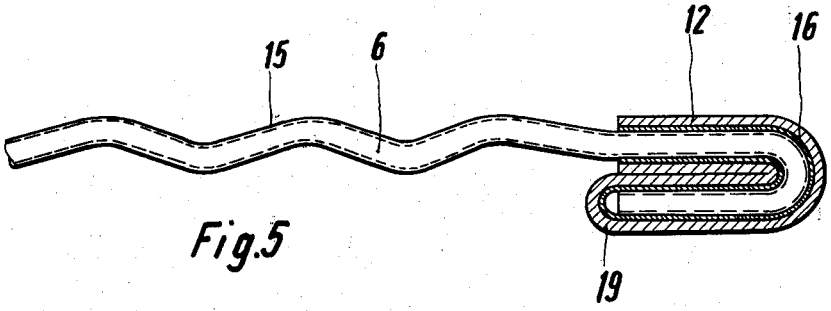
FIG. 5 is a view of the clamping bar according to FIG. 4 with an interposed resilient intermediate layer.

As an alternate to laterally inserting the U-shaped ends of wires 6 into the clamping bar, the spring wire mat supports may be easily provided with clamping bars 12 by positioning strips of steel sheet with the intermediate layer 16 thereon on the ends of the longitudinal wires and bending the strips along with the wire ends into U-shaped configuration, whereby the configuration of the clamping bars according to FIGS. 3 to 5 results.

The adjacent recesses in the hook rail 8' which define the V-shaped hook members 9 extend to such a degree into the horizontal flange 20 of the rail 8' that the longitudinal wire 6 per se do not contact the edged portion 17 of the flange 20 (FIG. 3) such that wear or breakage of the longitudinal wires at this point is positively avoided.

Now, it has been shown in a manner being surprising to the expert that the clamping mechanism according to the invention not only is effective to positively maintain the tension and to avoid overstrain of certain wires, but also that no wear is produced. Hereby, the service life of the spring steel mat support is substantially increased.

In view of the fact that the hooks 9 press the clamping bar 12 together at point 19 (FIG. 3) in combination with the longitudinal wire 6 in proportion to the adjusted tension, a sufficient clamping action on the longitudinal wires 6 is thus secured even under maximum loads. Therefore, the wires cannot be drawn out from the clamping bar 12 under any circumstances.

This combination results in a particularly simple mode of manufacturing if the resilient intermediate layer consists of rubber and is vulcanized to the steel sheet employed so that it can be cut together with the steel sheet. Further, in view of the fact that the clamping bar 12 according to the invention shows great stiffness in a direction normal to its longitudinal dimension, the adjacent recesses in the hook rails 8 and 8' defining the V-shaped hook members 9 may be of greater width such that the insertion of the spring steel mat support 5 is rendered substantially more easy.

What we claim is:

1. Bedstead comprising crossheads between which a woven mat support is stretched, said mat being made of spring steel wire, preferably plastic coated, and including longitudinal wire members having U-shaped ends, hook rails carried by said crossheads each having a row of spaced apart V-shaped hook members with recesses therebetween, the hook members of one hook rail pointing towards the hook members of the other hook rail, one of said hook rails being adjustable so as to tension said mat support, a double folded U-shaped clamping bar encasing the U-shaped ends of the longitudinal wire members, the wire receiving open edge of said U-shaped clamping bar being nested in and facing the closed ends of the V-shaped hook members of said adjustable hook rail such that a clamping force is exerted on said clamping bar and said U-shaped ends by said V-shaped hook members in proportion to tension force applied to said mat support by the adjustable hook rail.

2. Bedstead of claim 1 wherein a resilient intermediate layer is provided between said clamping bar and the ends of said longitudinal wires.

3. Bedstead of claim 2 wherein said resilient layer is a strip of plastic material inserted into the clamping bar.

4. Bedstead of claim 2 wherein said resilient layer is adhesively bonded to the clamping bar.

5. Bedstead of claim 1 wherein the adjustable hook rail has a horizontal flange, said recesses extending into said flange a distance such that such longitudinal wire members do not contact said flange.

* * * * *